US005141158A

United States Patent [19]

Allen

[11] Patent Number: 5,141,158

[45] Date of Patent: Aug. 25, 1992

[54] EDDY CURRENT BRAKED SPINNING JET NOZZLE

[75] Inventor: John T. Allen, Duncan, Okla.

[73] Assignee: Halliburton Company, Duncan, Okla.

[21] Appl. No.: 693,110

[22] Filed: Apr. 24, 1991

[51] Int. Cl.[5] ..... B05B 3/06

[52] U.S. Cl. ..... 239/252; 239/DIG. 11

[58] Field of Search ..... 239/252, 256, DIG. 11, 239/DIG. 13; 188/267

[56] References Cited

U.S. PATENT DOCUMENTS

| | | | |
|---|---|---|---|
| 4,164,325 | 8/1979 | Watson | 239/DIG. 13 X |
| 4,434,951 | 3/1984 | Nakajima | 188/267 X |
| 4,561,605 | 12/1985 | Nakajima | 188/267 X |
| 4,853,573 | 8/1989 | Wolcott et al. | 188/267 X |
| 5,039,013 | 8/1991 | Sawade et al. | 239/256 |
| 5,060,862 | 10/1991 | Pacht | 239/252 |

FOREIGN PATENT DOCUMENTS

| | | | |
|---|---|---|---|
| 314629 | 5/1989 | European Pat. Off. | 239/DIG. 13 |
| 2712395 | 9/1978 | Fed. Rep. of Germany | 239/252 |

OTHER PUBLICATIONS

"3-D or 2-D, Sugino Nozzles Offer Unbeatable Cleaning Efficiency With Minimal Effort" from Hydro-Manufacturing, believed to be dated at least one year prior to Apr., 1991. (Exhibit 1).

"Hydro-Manufacturing-2-D Nozzle Main Features" from Hydro-Manufacturing, believed to be dated at least one year prior to Apr., 1991. (Exhibit 2).

*Primary Examiner*—Andres Kashnikow

*Assistant Examiner*—William Grant

*Attorney, Agent, or Firm*—James R. Duzan; E. Harrison Gilbert, III

[57] ABSTRACT

A fluid jetting apparatus, such as nozzle, includes a support on which an orifice member is rotatably mounted. Orifices in the member are eccentric so that fluid exiting the orifices gives a driving force to rotate the orifice member relative to the support. To prevent the member from rotating too fast, a magnetic flux is provided to induce eddy currents in the support or the orifice member to produce a resisting torque opposing the speed-increasing torque resulting from the force of the fluid exiting the orifices. The eddy currents arise in response to relative motion between the magnetic flux and either the orifice member or the support.

6 Claims, 2 Drawing Sheets

EDDY CURRENT BRAKED SPINNING JET NOZZLE

BACKGROUND OF THE INVENTION

This invention relates generally to a fluid jetting apparatus. In a particular aspect, the present invention relates to a self-rotating jetting nozzle whose speed of rotation is restricted by eddy current damping.

In industrial cleaning (such as for removing rust, scale, etc. off of metal surfaces in heat exchanger tubes and in cracking towers, for example), various sizes of rotating nozzles can be used to apply streams of fluid to the surfaces to be cleaned. These nozzles typically rotate in response to one or more streams of fluid jetting from eccentric ports in the nozzles. The force of such a fluid stream not only rotates a nozzle, but also scours the impacted surface.

Self-destructive forces can occur in these nozzles if the speed of a rotating member is allowed to increase unchecked. Typical large nozzles (e.g., 3 inches in diameter or larger) have mechanical braking systems or viscous fluid braking systems to stop or retard the rotating members from rotating too fast. Typical self-rotating small nozzles of which I am aware, on the other hand, do not have any braking mechanism; therefore, these small nozzles can accelerate until such speeds are reached that they begin to self-destruct through friction, heat and centrifugal force. This is detrimental not only to the nozzle itself, but, also to the cleaning process and possibly to the object being cleaned. A catastrophic failure of this type can also be hazardous to personnel.

In view of this self-destructive nature, there is the need for some type of small nozzle whose speed can be limited or retarded to keep it from rotating at a destructive speed. The mechanism by which this is achieved must accommodate the small size of the nozzle itself as well as the small or tight environments where such a nozzle is to be used.

SUMMARY OF THE INVENTION

The present invention overcomes the above-noted and other shortcomings of the prior art by providing a novel and improved fluid jetting apparatus. In a particular aspect, the present invention provides a self-rotating nozzle whose speed of rotation is restricted so that the nozzle does not attain a self-destructive speed. This speed restriction is obtained by eddy current damping.

The present invention is implemented in a manner which is compatible with small sizes of nozzles and the small or limited space environments where such nozzles are to be used. It is noted, however, that the present invention also encompasses other sizes of nozzles.

Generally, the fluid jetting apparatus comprises: rotary means for rotating a stream of fluid in response to a driving force; and speed limiting means for creating electrical eddy currents in the apparatus in response to rotation of the rotary means so that a retarding force opposing the driving force is thereby produced. In a particular embodiment, the rotary means includes a support and an orifice member rotatably connected to the support, and the speed limiting means includes a permanent magnet connected to a selected one of the support and the orifice member so that magnetic flux from the magnet passes through the other of the selected one of the support and the orifice member. The speed limiting means can further include flux guide means for directing the magnetic flux through a directional path between the support and the orifice member.

Therefore, from the foregoing, it is a general object of the present invention to provide a novel and improved fluid jetting apparatus, which in a particular embodiment is an eddy current braked spinning jet nozzle. Other and further objects, features and advantages of the present invention will be readily apparent to those skilled in the art when the following description of the preferred embodiments is read in conjunction with the accompanying drawings.

DETAILED DESCRIPTION OF PREFERRED EMBODIMENTS

Figure 1:
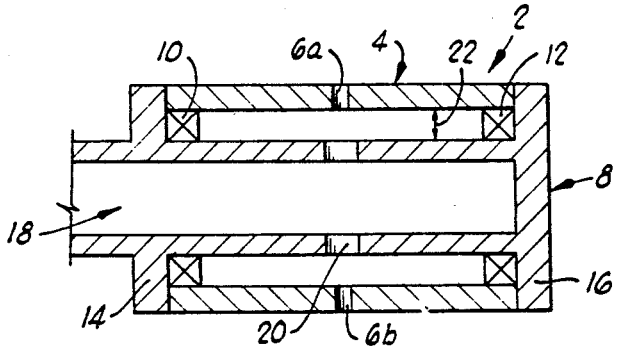
FIG. 1 is a sectional view of a representation of a fluid jetting apparatus including a spinning jet member braked by a force arising from eddy currents induced by rotation of the spinning jet member through a magnetic field.

A fluid jetting apparatus 2 of the present invention is represented in FIG. 1. It includes rotary means for rotating a stream of fluid in response to a driving force. The rotary means includes an orifice member, or nozzle head, 4 having one or more eccentric orifices 6 defined therein so that fluid exiting the orifices 6 supplies a force to rotate the member 4 about on axis of rotation. The orifices 6 are "eccentric" in that their respective centerlines do not intersect the centerline, or axis: of rotation, of the member 4.

The orifice member 4 is supported by a support 8 so that the member 4 is rotatable relative to the support 8. In the FIG. 1 representation, rotation is enhanced by bearings 10, 12 radially supporting the member 4. Longitudinal support is also provided, as schematically represented in FIG. by flanges 14, 16 of the support 8. Friction reducing supports can also be provided here if desired.

In addition to supporting the orifice member 4, the support 8 conducts fluid to the orifice member 4 through a hollow interior 18 and radial ports or openings 20 of the support 8. Thus, fluid can flow within the interior 18 of the support 8 and out through the openings 20, 6. Such exiting fluid provides one or more fluid jet streams (depending upon the number of orifices 6) which impart the driving rotational force to the orifice member 4 of the preferred embodiments. The magnitude of the force of each of these jets is dependent in a known manner upon the fluid pressure, the orifice size and the degree of eccentricity of the orifice.

The force applied by the jetting fluid rotates the orifice member 4 relative to the support 8. The force produces a mechanical torque on the orifice member 4 ($torque_{mech}$=force x distance of force from axis of rotation). The resultant speed of rotation can increase to a destructive level if the driving force is unopposed by other than the inherent frictional forces. To prevent this, the present invention further comprises speed limiting means for creating electrical eddy currents in the apparatus in response to rotation of the rotary means so that a retarding force opposing the driving force is thereby produced. Eddy currents are those currents that exist as a result of voltages induced in the body of a conducting mass by a variation of magnetic flux.

In the present invention the variation in flux is brought about by the relative rotation between the orifice member 4 and support 8 and a magnetic flux fixed with either the member 4 or the support 8. The magnetic flux is represented in FIG. 1 by the arrow 22. Eddy currents are thereby induced in either the member 4 or the support 8 depending upon the selected orientation.

In the preferred embodiments described herein, the magnetic flux is obtained from a permanent magnet connected to a selected one of the orifice member 4 and the support 8 so that magnetic flux from the magnet passes through the other of the support 8 and member 4. It is contemplated, however, that the magnetic flux can be obtained in any suitable manner and associated with the bodies of the member 4 or support 8 in any suitable manner. For example, it is contemplated that the selected member 4 or support 8 could be made at least in part of a permanent magnetic material rather than having a discrete magnet affixed as illustrated in the particular embodiments of FIGS. 2–4.

Regardless of the particular magnet means for providing the magnetic flux, the present invention is constructed to have the magnetic flux pass between the orifice member 4 and the support 8 so that a magnetic torque is produced in response to the relative motion between the orifice member 4 and the support 8 and the magnetic flux which is stationary with respect to either the orifice member 4 or the support 8. This magnetic torque opposes the mechanical torque produced in response to the fluid conducted through the support 8 to the orifice member and output from the orifice member 4. The magnetic torque is determined as known in the art ($torque_{meg}$=current x mechanical velocity x magnetic field strength x sine of the angle between the direction of the flux field and the mechanical velocity). This torque increases with increasing relative speed between the orifice member 4 and the support 8 (more particularly, with increasing speed relative to the flux field).

Figure 2:
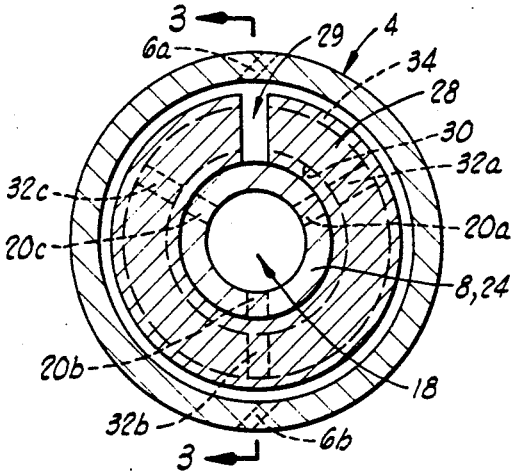
FIG. 2 is a sectional end view of a preferred embodiment of fluid jetting apparatus implementing the concept represented in FIG. 1.
Figure 3:
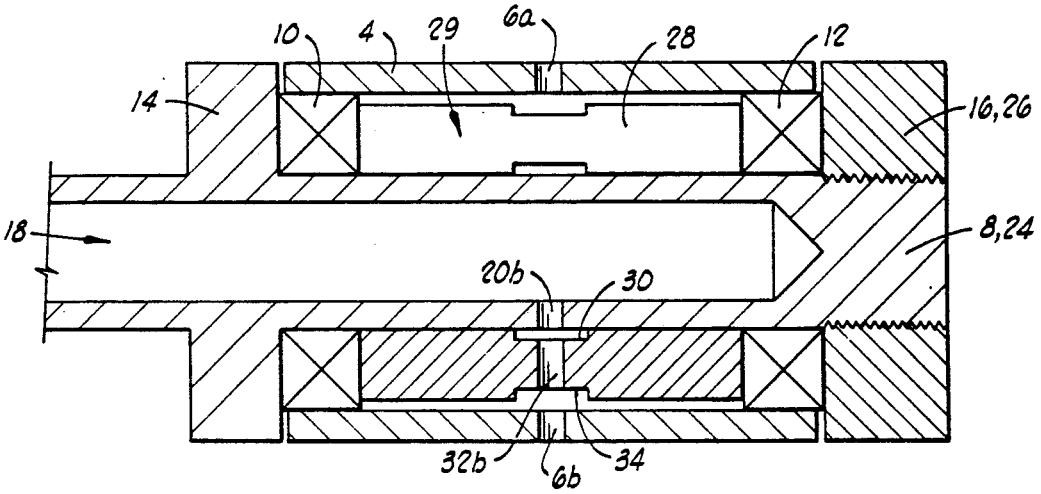
FIG. 3 is a sectional view taken along line 3—3 in FIG. 2.

FIGS. 2 and 3 illustrate a particular implementation of the invention more generally shown in FIG. 1. Like parts are identified in FIGS. 2 and 3 by the same reference numerals as used in FIG. 1.

The orifice member 4 of the embodiment in FIGS. 2 and 3 includes a cylindrical member rotatably connected to a tubular conduit 24 embodying the support 8. The cylindrical orifice member 4 is radially supported by bearings 10, 12 and longitudinally supported by flanges 14, 16, wherein flange 16 is implemented by a retaining nut 26 threaded on the end of the tubular conduit 24. The body of the orifice member 4 includes at least some electrically conductive material in which the eddy currents can be induced by rotation relative to the magnetic flux provided by a permanent magnet 28 mounted on the exterior of the conduit 24 as shown in FIGS. 2 and 3.

The permanent magnet 28 of the embodiment in FIGS. 2 and 3 has a hollow cylindrical shape split by a longitudinal air gap 29 across which the flux passes. It is through this flux that the orifice member 4 moves as it is rotated by the jetting fluid exiting the one or more orifices 6.

The magnet 28 is held stationary on the conduit 24 between the bearings 10, 12. The magnet 28 has an inner circumferential groove 30 overlying the one or more openings 20 (three are illustrated in FIG. 2) in the support conduit 24. One or more ports 32 (three are illustrated in FIG. 2) communicate through the body of the magnet 28 and intersect the groove 30 and an outer circumferential groove 34 of the magnet 28. These openings provide a passageway through the magnet 28 to communicate fluid from the openings in the conduit 24 to the orifices in the member 4.

To construct the embodiment shown in FIGS. 2 and 3, the bearing 10, the magnet 28 and the bearing 12 are placed on the free end "axle" portion of the conduit 24 in the order shown in FIG. 3. Radially outwardly encasing these is the cylindrical orifice member 4. These components are secured in their respective locations by screwing the retaining nut 26 onto the threaded tip of the free end of the conduit 24.

Figure 4:
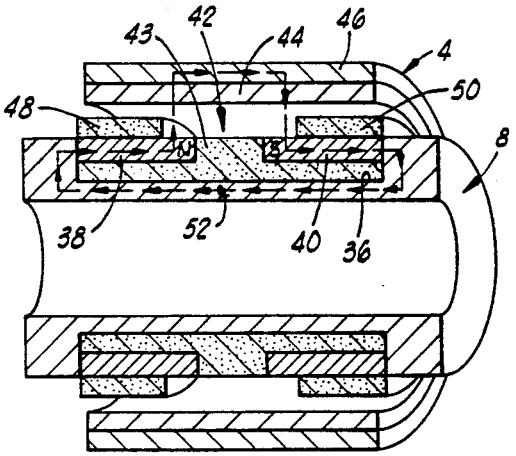
FIG. 4 is a partial sectional side perspective view of another preferred embodiment of fluid jetting apparatus implementing the concept represented in FIG. 1.

Referring to FIG. 4, another particular implementation of the present invention will be described. Again, like parts to the more general embodiment shown in FIG. are marked with the same reference numerals as are used in FIG. 1.

The portion of the support 8 shown in FIG. 4 includes a magnetically conductive material such as iron or steel. A circumferential groove 36 is defined in the outer surface of the support 8. Retained in the groove 36 are two permanent magnets 38, 40. Each of these has a hollow cylindrical shape which is continuous. That is, there is no air gap within either respective magnet 38, 40. Rather, in the FIG. 4 embodiment an air gap 42 is defined circumferentially by longitudinally spacing or separating the magnets 38, 40 with opposing poles facing each other. This is obtained by supporting the magnets 38, 40 on a suitable conforming layer 43 of material having low permeability to magnetic flux. In the FIG. 4 embodiment, the layer 43 extends radially between the support 8 and the magnets 38, 40 and longitudinally between the facing ends of the magnets 38, 40.

Mounted radially outwardly from the foregoing is the orifice member 4. In the FIG. 4 embodiment, this includes an inner layer 44 of a non-magnetic conductor which is electrically conductive, such as copper. Overlying this layer is an outer layer 46 of magnetically conductive material, such as iron or steel.

In the same general manner as in the previously described embodiments, the foregoing construction causes eddy currents to be induced in the layer 44 as the orifice member 4 rotates relative to the support 8 and the magnets 38, 40. Added to the FIG. 4 embodiment, however, is a flux guide means for directing the magnetic flux through a directional path between the support 8 and the orifice member 4. This is used to force the angle between the flux field and the rotating member as close to 90° as desired or possible to maximize the sine of this angle and thereby maximize $torque_{mag}$ defined hereinabove.

The flux guide is defined in the FIG. 4 embodiment by two bands 48, 50 of material having low permeability to magnetic flux. The bands 48, 50 are mounted adjacent the magnets 38, 40, respectively. Each band extends longitudinally along the respective magnet a sufficient distance to obtain the desired focusing of the magnetic flux.

With the configuration and pole orientation of the components shown in FIG. 4, the magnetic flux flows along the path indicated by the arrows 52. This path includes: the magnetically conductive material of the support 8 extending around the groove 36 (adjacent which the longitudinally outer ends of the magnets 38, 40 are disposed); the magnets 38, 40; the directional path through the gap between the closer ends of the magnets 38, 40 and the orifice member 4; and the layer 46 of magnetically conductive material of the orifice member 4. As relative movement occurs, eddy currents 10 are induced in the electrically conductive layer 44 of the orifice member 4.

Although not shown in FIG. 4, openings are provided to communicate fluid from the support 8 to orifices (also not shown in FIG. 4) of the orifice member 4 in the same manner as described hereinabove. Likewise, construction would be done: in the same manner or as would otherwise be readily apparent to those skilled in the art.

Figure 5:
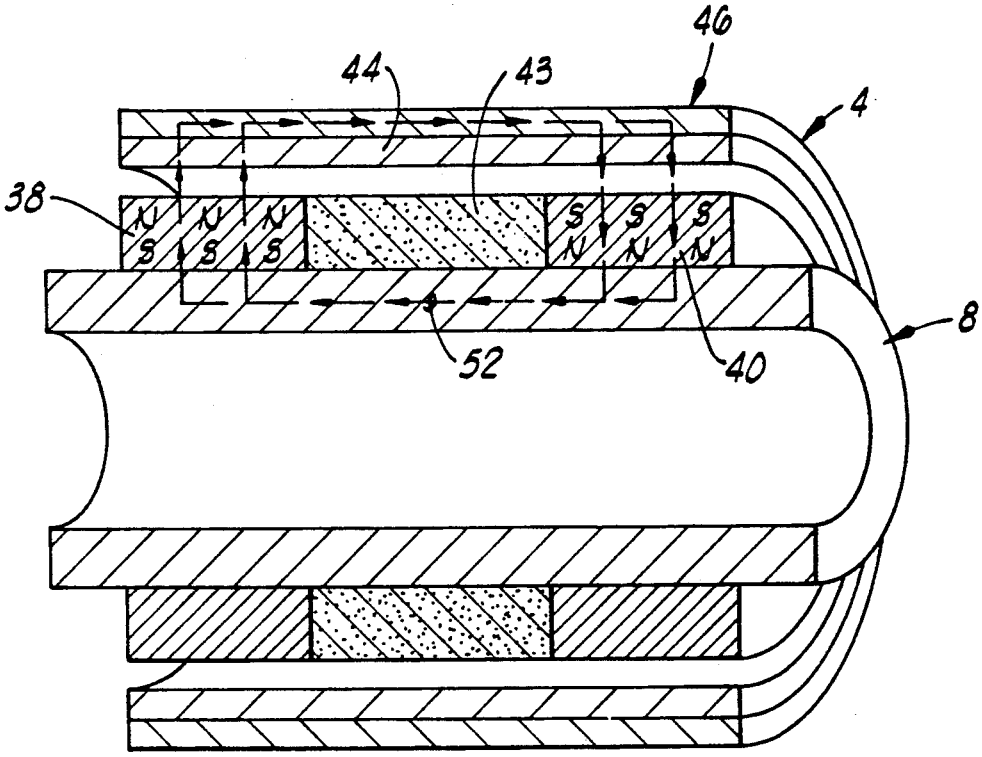
FIG. 5 is a partial sectional side perspective view of still another preferred embodiment of fluid jetting apparatus implementing the concept represented in FIG. 1.

The embodiment shown in FIG. 5 includes the same elements as in the FIG. 4 embodiment, except that the FIG. 5 embodiment does not include the bands 48, 50 of low permeability material (additionally, the magnets 38, 40 have their poles radially, rather than longitudinally, disposed as shown by the labeling in the drawings). This permits the diameter of the device to be reduced, thereby making the device more compact. This reduces the distance between the magnets 38, 40 and the layer 46 of magnetically conductive material, which reduced distance itself increases the tendency of the flux to follow the desired path illustrated in FIG. 5.

For any of the foregoing embodiments, the mechanical torque for a particular design is a constant as determined by the jet pressure, the orifice size, and the degree of eccentricity of the orifices as known in the art. The resisting or retarding torque caused by the induced eddy currents will, on the other hand, increase with increasing rotational speed of the respective orifice member 4 because this torque is a function of this speed as shown in the formula for $torque_{mag}$ set forth above. If the rotational speed increases sufficiently, this magnetically produced torque will increase until it equals the net mechanical driving torque of the jetting fluid (i.e., the net torque produced by the fluid force and any inherent opposing forces, such as friction). When these opposing torques are equal, the orifice member 4 will cease to accelerate and it will maintain a constant and predeterminable speed.

Components used for implementing the present invention can be of any suitable materials known in the art. Specific materials can be chosen based on particular applications or needs. One possible magnetic material is Alnico IV, but it is contemplated that other materials may be preferable. In general, for magnetic materials, the higher the field strength which can be obtained in the available space for a particular application, the more latitude there will be for the other design parameters.

The present invention is particularly suitable for small nozzles (e.g., $\frac{1}{2}''$–$\frac{3}{4}''$ in diameter) where size constraints prohibit larger types of braking devices or systems; however, it is contemplated that the present invention can be applied to devices of any size capable of accommodating components for implementing the present invention. Likewise, the present invention is not inherently limited to any particular application. Non-limiting examples of uses to which the present invention can be put are in line moles, cracking tower cleaners and heat exchanger tube cleaners.

Thus, the present invention is well adapted to carry out the objects and attain the ends and advantages mentioned above as well as those inherent therein. While preferred embodiments of the invention have been described for the purpose of this disclosure, changes in the construction and arrangement of parts can be made by those skilled in the art, which changes are encompassed within the spirit of this invention as defined by the appended claims.

What is claimed is:

1. A fluid jetting apparatus, comprising:

rotary means for rotating a stream of fluid in response to a driving force, said rotary means including a support and an orifice member rotatably connected to said support; and speed limiting means for creating electrical eddy currents in said apparatus in response to rotation of said rotary means so that a retarding force opposing said driving force is thereby produced, said speed limiting means including a permanent magnet connected to a selected one of said support and said orifice member so that magnetic flux from said magnet passes through the other of said selected one of said support and said orifice member, and said speed limiting means further including flux guide means for directing the magnetic flux through a directional path between said support and said orifice member.

2. An apparatus as defined in claim 1, wherein said flux guide means includes a band of material having low permeability to magnetic flux, said band disposed radially outwardly of and adjacent said magnet along less than the full length of said magnet.

3. A fluid jetting apparatus, comprising:

a tubular conduit, said conduit having an opening defined therein through which a fluid conducted through said conduit can flow;

a cylindrical member rotatably connected to said conduit, said member including an electrically conductive material, said member having an eccentric orifice defined therein; and a permanent magnet providing a magnetic flux, said permanent magnet connected to said conduit so that said magnetic flux passes through said member, wherein eddy currents flow in said member in response to relative rotation between said magnet and said member, said magnet having a passageway defined therein in fluid communication with both said opening in said conduit and said orifice in said member.

4. An apparatus as defined in claim 3, wherein said magnet includes a cylindrical body having a longitudinal air gap.

5. A fluid jetting apparatus, comprising:

a tubular conduit;

a cylindrical member radially spaced from and rotatably connected to said conduit, said member including an electrically conductive material;

a permanent magnet providing a magnetic flux, said permanent magnet connected to said conduit so that said magnetic flux passes through said member, wherein eddy currents flow in said member in response to relative rotation between said magnet and said member, said magnet including two hollow cylindrical bodies encircling said conduit and spaced from each other on said conduit, wherein said conduit includes magnetically conductive material adjacent opposite ends of said two cylindrical bodies of said magnet, said magnetically conductive material of said conduit defining a magnetic flux flow path within said conduit; and low magnetic flux permeability means disposed relative to said magnet for directing the path of the magnetic flux between said magnet and said member, said low magnetic flux permeability means including:

a first band, disposed circumferentially around one of said cylindrical bodies of said magnet; and a second band, disposed circumferentially around the other of said cylindrical bodies of said magnet;

wherein said first and second bands extend longitudinally along, but less than the full lengths of, the respective said cylindrical bodies.

6. A fluid jetting apparatus, comprising:

a tubular conduit;

a cylindrical member radially spaced from and rotatably connected to said conduit, said member including an electrically conductive material;

a permanent magnet providing a magnetic flux, said permanent magnet connected to said conduit so that said magnetic flux passes through said member, wherein eddy currents flow in said member in response to relative rotation between said magnet and said member, said magnet including two hollow cylindrical bodies encircling said conduit and spaced from each other on said conduit, one of said cylindrical bodies having a radially outer magnetic north pole and a radially inner magnetic south pole adjacent said conduit and the other said cylindrical body having a radially outer magnetic south pole and a radially inner north pole adjacent said conduit.

* * * * *